United States Patent [19]

Bardini et al.

[11] Patent Number: 4,727,617

[45] Date of Patent: Mar. 1, 1988

[54] CHIMNEY CLEANING APPARATUS

[76] Inventors: Armando J. Bardini, 136 Hanley Dr., Grass Valley, Calif. 95945; Gary R. Caravantes, 1788 Edgewater Ct., Greenwood, Calif. 95635

[21] Appl. No.: 806,598

[22] Filed: Dec. 9, 1985

[51] Int. Cl.[4] ..... F23J 3/00

[52] U.S. Cl. ..... 15/163; 15/243; 15/249

[58] Field of Search ..... 15/162, 163, 242, 243, 15/246.5, 249; 52/404

[56] References Cited

U.S. PATENT DOCUMENTS

| | | | |
|---|---|---|---|
| 2,200,713 | 5/1940 | Ericson et al. | 52/404 |
| 3,589,609 | 6/1971 | Wyant | 15/249 X |
| 4,340,989 | 7/1982 | Rotondi . | |
| 4,483,038 | 11/1984 | Boehland . | |
| 4,498,208 | 2/1985 | Henderson . | |
| 4,505,000 | 3/1985 | Boehland . | |
| 4,562,608 | 1/1986 | Weir | 15/163 |

FOREIGN PATENT DOCUMENTS

| | | | |
|---|---|---|---|
| 1147512 | 6/1983 | Canada | 15/163 |
| 87954 | 7/1895 | Fed. Rep. of Germany | 15/163 |

*Primary Examiner*—Peter Feldman

[57] ABSTRACT

An improved fully automatic motor driven cleaning apparatus, which is permanently installed in a heat insulated compartment over the outlet of the chimney, without any portion of the mechanism extending into or attaching to the chimney or flue. The cleaning device is returned to a position above the chimney outlet after each cleaning cycle. The unit is remotely operated by a separate and detachable control module which plugs into any household electrical outlet.

1 Claim, 9 Drawing Figures

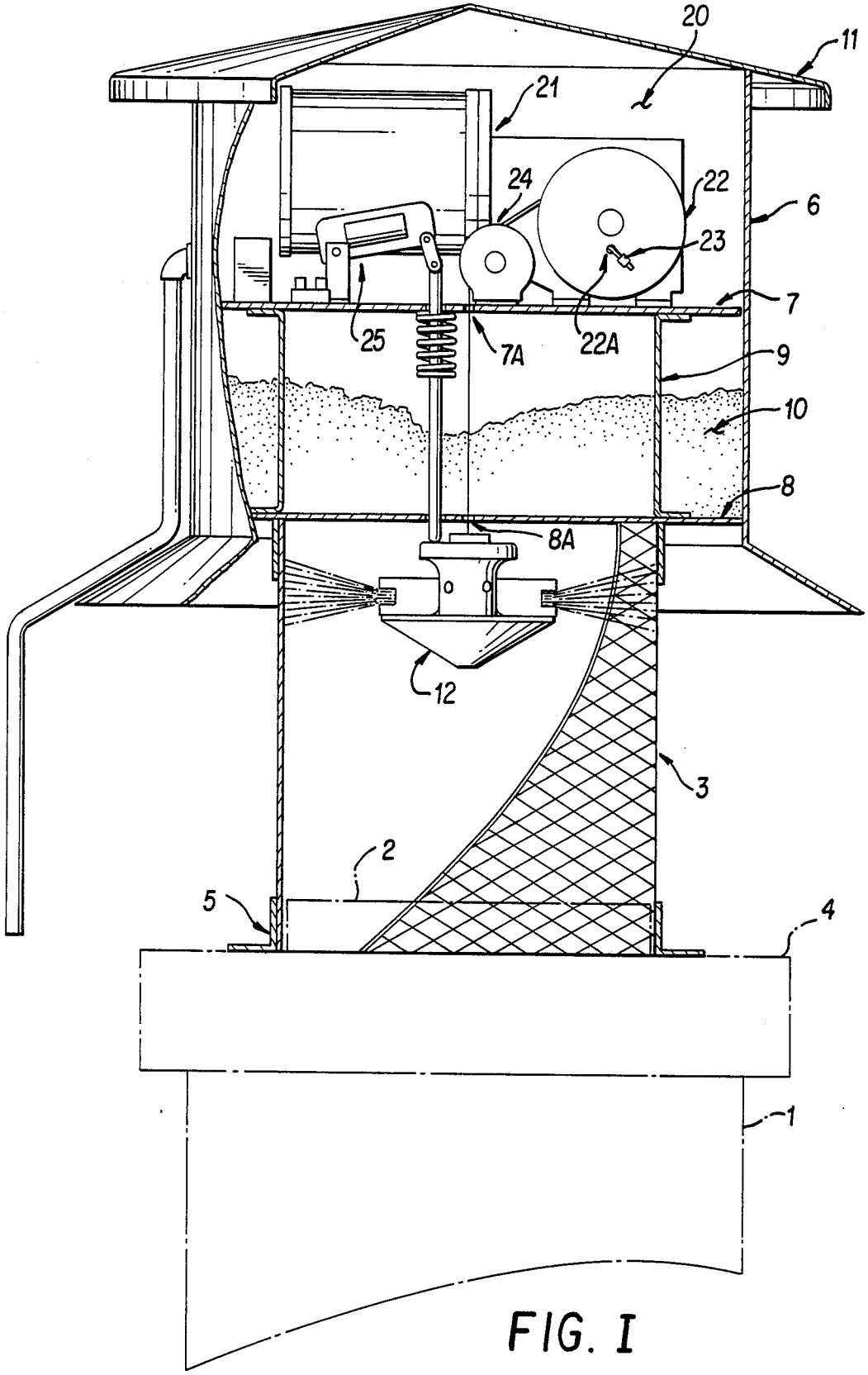
FIG. I

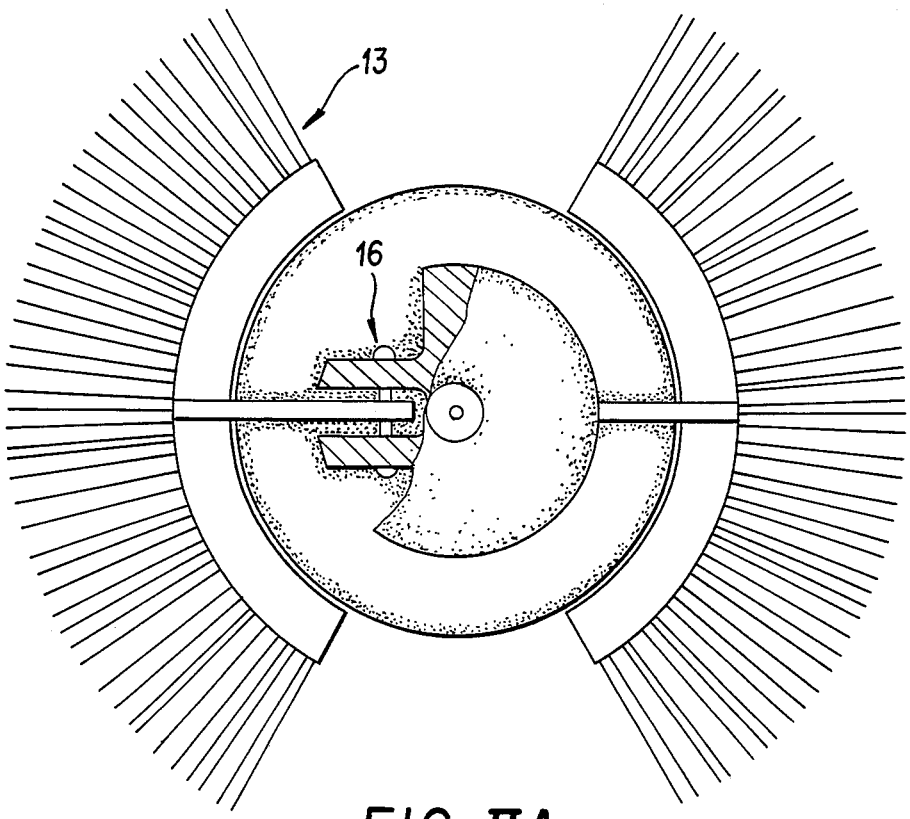
FIG. IIA
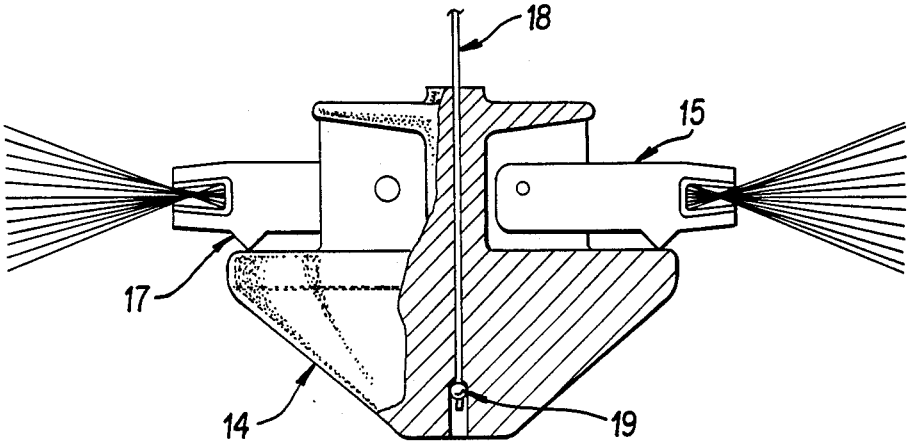
FIG. IIB

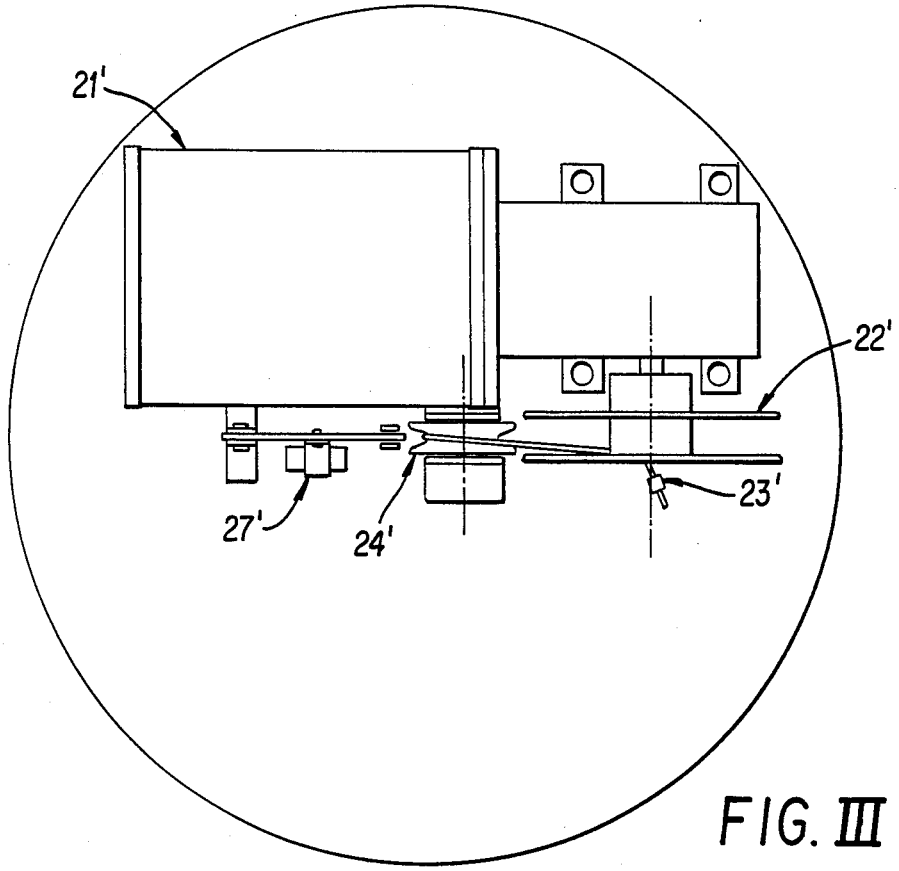
FIG. III
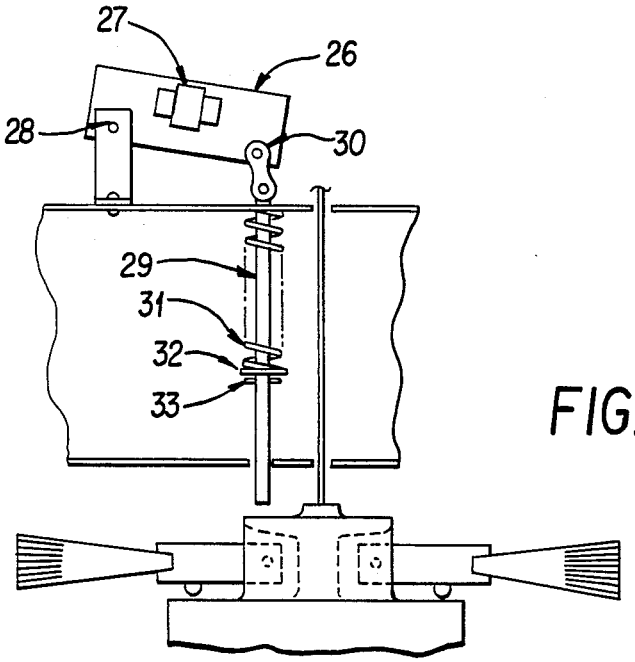
FIG. IV

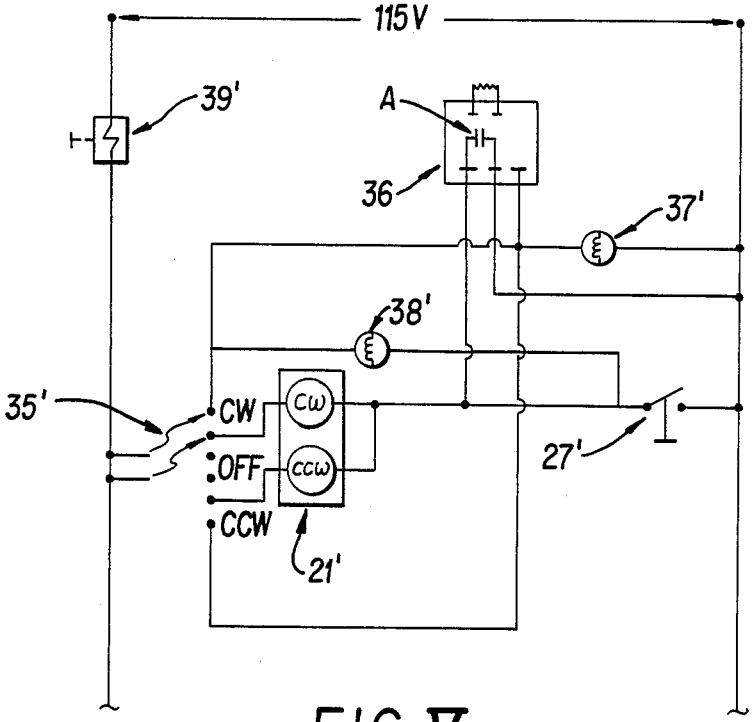
FIG. V
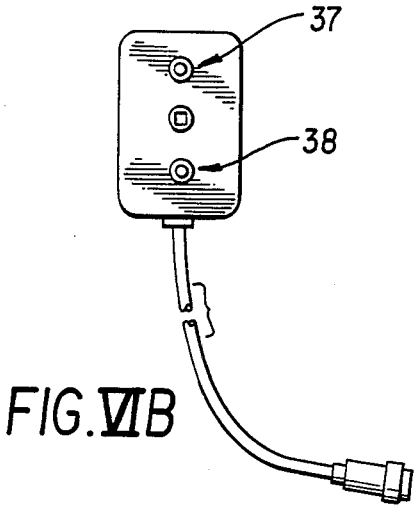
FIG. VIB
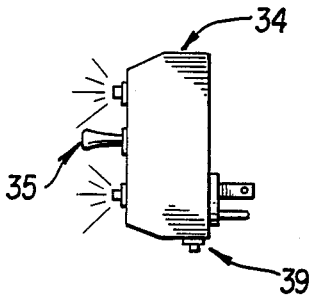
FIG. VI

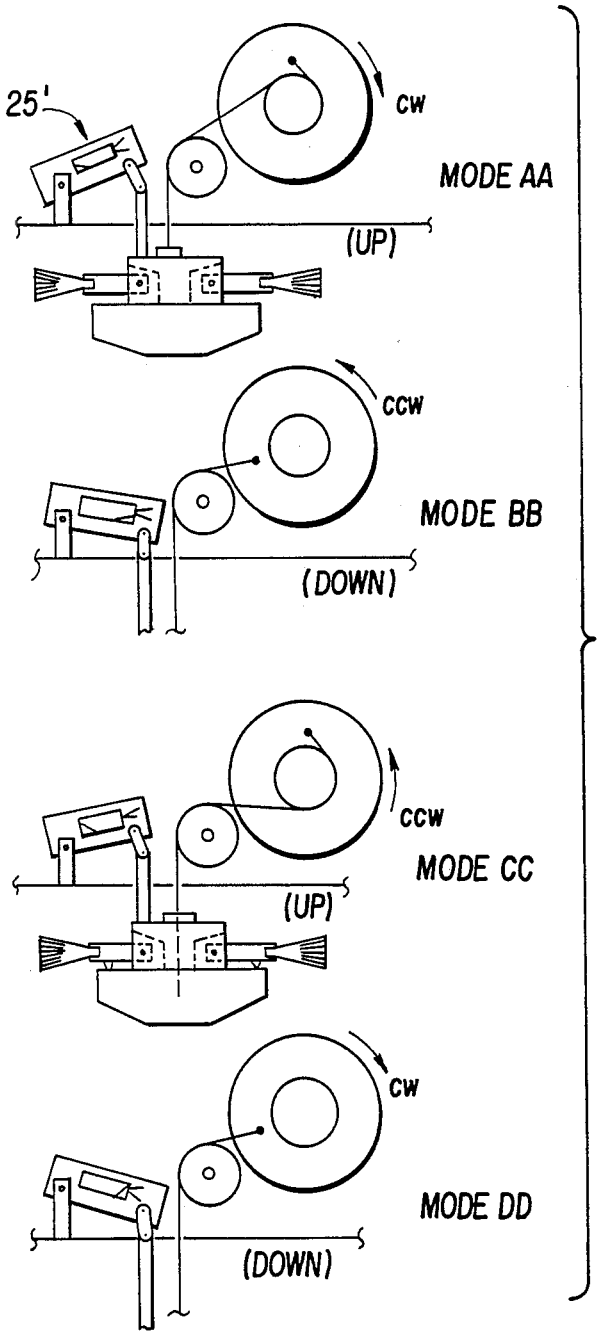
FIG. VII

CHIMNEY CLEANING APPARATUS

FIELD OF INVENTION

The present invention relates to a completely automatic apparatus for cleaning the interior of chimneys, smokestacks and the like.

DISCUSSION OF PRIOR ARTS

Heretofore, typically the mechanisms are incorporated inside and throughout the length of the chimney or smoke conduit. The prior art discloses various arrangements for moving a cleaning brush or device along the length of the chimney. Examples of the prior art systems are found in U.S. Pat. Nos. 4,340,989-4,483,038-4,505,000-4,498,208.

In reference U.S. Pat. No. 4,498,208; illustrates a manually operated cleaning arrangement, whereby the mechanism extends into and attaches to the smoke conduit.

In reference U.S. Pat. No. 4,505,000; illustrates a motorized cleaning device propelled by a cable and pulley arrangement, and supporting structure extending throughout the length of the smoke conduit.

In reference U.S. Pat. No. 4,483,038; illustrates a reversible electric motor which drives a brush carrying threaded shaft centrally disposed along a length of the chimney conduit and linked to a second switching mechanism.

In reference U.S. Pat. No. 4,340,989; illustrates a manually operated cleaning arrangement, whereby the mechanism extends into and attaches to the smoke conduit.

OBJECTIVES AND ADVANTAGES OF THIS INVENTION

Accordingly several objects of this invention are as follows:

(1) A thermally insulated and permanently installed motorized cleaning apparatus, which can withstand the severe high temperature operating conditions.

(2) The entire cleaning apparatus is mounted above the chimney outlet without any portion thereof extending into the smoke conduit.

(3) The cleaning apparatus can be installed without any modifications or alteration to the existing chimney.

(4) The cleaning apparatus can be remotely operated from inside the dwelling at the stove or fireplace location.

(5) An electronic control module, which can be easily disconnected and stored away, out of reach of children.

Further objects and advantages of this invention will become apparent from a consideration of the drawings and ensuing description thereof.

BRIEF DESCRIPTION OF THE DRAWING

In the drawing:

FIG. I, is an elevation view and section of the apparatus installed on the chimney.

FIGS. IIA and IIB are an elevation and plan views of the cleaning device.

FIG. III, is a plan view of the cable drive mechanism.

FIG. IV, is an elevation view of the mercury switch mechanism.

FIG. V, is an electrical schematic.

FIGS. VIA and VIB are side and front views, respectively, of the control module.

FIG. VII, is an illustration of the sequence of operation.

SUMMARY OF THE PRESENT INVENTION

The purpose of the present invention is to provide an electrically powered and fully automatic chimney cleaning apparatus, which is permanently installed at the top or outlet of the chimney. The cleaning operation is accomplished by automatically lowering a cleaning device into the chimney and raising it back to its stored location above the smoke outlet. The chimney cleaning cycle is initiated remotely by actuating a switch on a control module.

The entire motorized mechanism is completely enclosed in a heat insulated compartment above the chimney outlet, without any portion of the apparatus extending into the chimney below the spark arrestor and smoke outlet. The important objectives of the present system are as follows;

It can be installed on most chimneys without any modifications by merely replacing the existing rain cap.

The drive mechanism, including the cleaning device, do not extend into or attach to the interior of the chimney or smoke conduit.

The cleaning device only enters the chimney when it is placed in operation, otherwise it is stored above the smoke outlet.

The cleaning device is designed to lower freely into the chimney and to clean on its return stroke and upward motion.

The unit always completes its cycle in the up or stored location above the outlet.

The cleaning device is designed to operate under the high temperature conditions and while the stove or fireplace is in use.

The electronic control module is completely separate from the drive mechanism at the top of the chimney.

The module which plugs into any household electrical outlet can be unplugged and stored away, out of reach of children until the cleaning apparatus is to be used again.

DETAILED DESCRIPTION OF THE PREFERRED EMBODIMENT

With continued attention to the drawing wherein applied referenced numerals indicate parts herein after similarly identified, the reference numeral (1) indicates a smoke conduit such as a chimney, smokestack, exhaust pipe, or the like, through which the products of combustion are vented to the atmosphere through an opening (2). A base or supporting structure indicated generally at (3) which is comprised of a circular perforated metal spark arrestor which fits on to the smoke conduit. The supporting structure includes (4), a rain collar forming a mounting platform which is attached to the spark arrestor by means of several brackets (5). A drive mechanism enclosure (6) which is comprised of (7), a circular plate which serves as a mounting base for the drive mechanism. A second circular plate (8), spaced directly below and attached by spacing brackets (9) forms a thermal insulating compartment filled with (10) a high temperature resistant insulating material and a rain cap (11) which encloses the drive mechanism. FIGS. I, IIA and IIB show a cleaning device. Consisting of two pivoting brush segments (13) which are pivoted on a central weighted hub (14). The brush segments are secured to a pivot arm (15), which pivots on pins (16) in the hub. The arms are free to pivot upward allowing the brush segments to move free from contact with the interior of the chimney as the cleaning device is lowered into the chimney. The brush segments are held firmly in the horizontal position, when the device moves upward, by the stops (17). The stops on the arm provide the reactive force that holds the brush segments into sweeping contact with the chimney. The cleaning device is suspended by a stainless steel cable (18), secured to the hub by the ball attachment (19). A cable drive mechanism generally shown at (20), by FIG. I and FIG. III, consisting of a gearhead drive motor (21), which turns a cable drum (22). A length of cable, equal approximately to the length of travel of the cleaning device (length of chimney), is attached to the drum by feeding the end of the cable through a hole (22A) on the cable drum flange and fastened securely by a cable crimp (23). The cable is routed from the drum and over the guide roller (24) and down through the insulating compartment through the holes (7A) and (8A). A mercury switch mechanism generally shown by (25) and by FIG. IV. The switch mechanism consists of a pivot plate (26) with mercury switch assembly (27) attached to its side. The pivot pin (28) allows the mercury switch to pivot upward to the "off" position when the actuating rod (29) is forced upward as the cleaning device reaches the stored position. The connecting link (30) allows the switch arm to move freely in an arc. When the cleaning device is lowered, the compression spring (31) returns the mercury switch assembly to the "on" position. The compression spring forces the actuating rod down, by acting on the retaining collar (32) and pin (33) in the actuating rod. FIG. V is a schematic of the control circuit, FIG. VI shows the layout of the control module (34) and FIG. VII illustrates the sequence of operation. The cycle is initiated by the selector switch (35), FIG. V and FIG. VI. The control operation can be best understood by referring to the FIG. VII and the schematic FIG. V.

In mode (AA), the cleaning device has been returned by rewinding in the clockwise direction and motion is stopped by the mercury stop switch. The selector switch (35) is in the clockwise position and timer contact (A) is open. In mode (BB), the selector switch has been moved to the counter clockwise position, energizing the timer (36) and momentarily closing contact "A" for a preset period of time, bypassing the mercury stop switch. This allows the cleaning device to lower, permitting the mercury stop switch to close. The cleaning device has been lowered to the bottom of the chimney and automatically rewinds back to the stored position by counterclockwise rotation of the drum as shown in mode (CC). In mode (DD) the selector switch (35) has been moved to the clockwise position, again momentarily closing timer contact "A" allowing the mercury stop switch to close. The sequence of operation is completed when the cleaning device reaches mode (AA) as shown.

The control module (34) and shown in FIG. VI, plugs directly into a standard 115 VAC receptacle. The purpose of the timer contact "A", in the solid state timing device (36), is to initiate a new cycle each time the selector switch (35) is activated. This is accomplished by momentarily closing contact "A" which allows the mercury stop switch (27) to close as the cleaning device lowers. The center position of the selector switch is the "power off" position. When the selector switch is moved to the clockwise or counter clockwise position, both the power-on light (37) and operating light (38) are illuminated. When the cleaning device completes the cycle and is stored in the up position, the operating light goes out. When the selector switch is moved to the center position, the power-on light goes out. The electrical circuitry is protected against an overload by a push button circuit breaker (39).

While we have shown but one embodiment of the invention, it will be apparent to those skilled in the art that the invention may be embodied still otherwise without departing from the spirit and scope of the invention. Having thus described the invention, what is desired to be secured under a Letters patent is:

We claim:

1. A chimney cleaning apparatus comprising in combination:

a. a support structure disposed on the upper edge surface of the chimney, said support structure having a horizontally oriented plate member that is spaced a predetermined distance above said upper edge surface so as to allow the products of combustion to be vented to the atmosphere, b. a cable drive mechanism mounted on said plate member, said cable drive mechanism comprising a reversible electric motor and a rotary cable drum drivingly coupled with said electric motor, said plate member provided with an opening to allow said cable to pass therethrough, c. a cable secured at one end to said rotary drum, the length of the cable being approximately the length of the chimney to be cleaned and defining the bottom of the length of travel of the cleaning stroke, d. a brush cleaning means for cleaning the inner surfaces of the chimney, said brush cleaning means being secured to the other end of said cable, e. a motor control circuit for causing the rotary drum to unwind the cable and move the cleaning means downwardly from a stored position above the chimney to its lowermost length of travel inside the chimney and then to automatically rewind said cable and move said brush cleaning means upwardly back to said stored position in one continuous, uninterrupted cycle, without reversing the rotation of said electric motor and rotary drum, f. said motor control circuit including a limit switch device that is activated to close and make electrical contact with said motor control circuit when the brush cleaning means is allowed to be lowered and to be de-activated to make open electrical contact with said motor control circuit when said brush cleaning means reaches said stored position, in order to de-energize said electric motor and thus stop the upward travel of said brush cleaning means, g. said motor control circuit further including a switch means for energizing said electric motor when said brush cleaning means is located in its stored position, said switch means being electrically coupled with the limit switch device whereby, when said switch means is activated to energize said electric motor, said brush cleaning means starts its descent into said chimney to start another cleaning cycle and causes said limit switch to make electrical contact with said motor control circuit, said switch means further including electrically coupled control means to sequentially alternate the reversibility of rotation of the electric motor for the next brush cleaning cycle.

* * * * *